US009561411B2

(12) United States Patent
Mizutani

(10) Patent No.: US 9,561,411 B2
(45) Date of Patent: Feb. 7, 2017

(54) GOLF CLUB HEAD AND DETACHABLE WEIGHTED SOLE PLATE AND COVER PLATE

(71) Applicant: DUNLOP SPORTS CO. LTD., Kobe-shi, Hyogo (JP)

(72) Inventor: Naruhiro Mizutani, Kobe (JP)

(73) Assignee: DUNLOP SPORTS CO. LTD., Kobe-Shi (JP)

( * ) Notice: Subject to any disclaimer, the term of this patent is extended or adjusted under 35 U.S.C. 154(b) by 0 days.

(21) Appl. No.: 14/749,235

(22) Filed: Jun. 24, 2015

(65) Prior Publication Data

US 2015/0375066 A1 Dec. 31, 2015

(30) Foreign Application Priority Data

Jun. 25, 2014 (JP) ..... 2014-130806

(51) Int. Cl.
*A63B 53/04* (2015.01)
*A63B 53/06* (2015.01)

(52) U.S. Cl.
CPC ..... *A63B 53/0466* (2013.01); *A63B 53/06* (2013.01); *A63B 2053/0433* (2013.01); *A63B 2053/0437* (2013.01); *A63B 2053/0491* (2013.01)

(58) Field of Classification Search
CPC ..... A63B 2053/0433; A63B 2053/0491
USPC ..... 473/324, 328, 334, 335, 344, 345
See application file for complete search history.

(56) References Cited

U.S. PATENT DOCUMENTS 1,269,745 A * 6/1918 Robertson ..... A63B 53/04 473/344
1,607,284 A * 11/1926 Kraeuter ..... A63B 53/04 473/332
3,556,533 A * 1/1971 Hollis ..... A63B 53/04 411/900
3,582,081 A * 6/1971 Caplan ..... A63B 53/04 273/DIG. 1
3,606,327 A * 9/1971 Gorman ..... A63B 53/04 473/297
3,815,921 A * 6/1974 Turner ..... A63B 53/04 473/328
4,085,934 A * 4/1978 Churchward ..... A63B 53/04 473/338
4,340,230 A * 7/1982 Churchward ..... A63B 53/04 473/339

(Continued)

FOREIGN PATENT DOCUMENTS

JP 2012-500044 A 1/2012

*Primary Examiner* — William Pierce
(74) *Attorney, Agent, or Firm* — Birch, Stewart, Kolasch & Birch, LLP

(57) ABSTRACT

A golf club head includes a head body having a crown portion, a face portion, and a sole portion; at least one regular weight member configured to be detachably attached to the sole portion; and a cover kit configured to be detachably attached to the sole portion. The cover kit includes a cover provided with a decoration and configured to cover at least a portion of the sole portion, and optionally includes at least one auxiliary weight member configured to be attached to the cover. A weight of the cover kit is the same as the weight of the regular weight member. The sole portion is configured to selectively be in one of a first mode in which the regular weight member is attached, and a second mode in which the cover kit is attached.

4 Claims, 4 Drawing Sheets

(56) References Cited

U.S. PATENT DOCUMENTS 4,553,755 A * 11/1985 Yamada ..... A63B 53/04 473/338
4,795,159 A * 1/1989 Nagamoto ..... A63B 53/04 473/338
5,154,424 A * 10/1992 Lo ..... A63B 53/04 473/338
5,251,901 A * 10/1993 Solheim ..... A63B 53/04 473/338
5,261,664 A * 11/1993 Anderson ..... A63B 53/04 473/342
5,273,283 A * 12/1993 Bowland ..... A63B 53/04 473/338
5,582,553 A * 12/1996 Ashcraft ..... A63B 53/04 473/338
5,692,972 A * 12/1997 Langslet ..... A63B 53/04 473/332
5,779,560 A * 7/1998 Buck ..... A63B 53/04 473/329
5,807,188 A * 9/1998 Serrano ..... A63B 53/04 473/338
6,033,318 A * 3/2000 Drajan, Jr. ..... A63B 53/02 473/309
7,396,296 B2 * 7/2008 Evans ..... A63B 53/0466 473/344
7,744,484 B1 * 6/2010 Chao ..... A63B 53/0466 473/324
8,062,151 B2 11/2011 Boyd et al.
8,162,776 B2 4/2012 Boyd et al.
8,235,841 B2 * 8/2012 Stites ..... A63B 53/0466 473/328
8,403,771 B1 * 3/2013 Rice ..... A63B 53/04 473/328
8,430,763 B2 * 4/2013 Beach ..... A63B 53/06 473/307
8,585,514 B2 11/2013 Boyd et al.
8,821,312 B2 * 9/2014 Burnett ..... A63B 49/06 473/329
8,827,831 B2 * 9/2014 Burnett ..... A63B 49/06 473/329
8,900,069 B2 * 12/2014 Beach ..... A63B 53/06 473/329
8,911,302 B1 * 12/2014 Ivanova ..... A63B 53/0475 473/329
9,216,331 B2 * 12/2015 Greensmith ..... A63B 53/06
2001/0055995 A1 * 12/2001 Cackett ..... A63B 53/02 473/342
2002/0128089 A1 * 9/2002 Sillers ..... A63B 53/0466 473/335
2002/0142861 A1 * 10/2002 Helmstetter ..... A63B 53/02 473/342
2002/0183134 A1 * 12/2002 Allen ..... A63B 53/04 473/329
2003/0100381 A1 * 5/2003 Murphy ..... A63B 53/02 473/342
2003/0157995 A1 * 8/2003 Mahaffey ..... A63B 53/04 473/342
2004/0192463 A1 * 9/2004 Tsurumaki ..... A63B 53/0466 473/329
2007/0078028 A1 * 4/2007 Huang ..... A63B 53/0466 473/324
2008/0076597 A1 * 3/2008 Roach ..... A63B 53/04 473/342
2011/0028238 A1 * 2/2011 Boyd ..... A63B 53/04 473/342
2011/0294589 A1 * 12/2011 Stites ..... A63B 53/0466 473/290
2013/0165251 A1 * 6/2013 Jorgensen ..... A63B 53/06 473/328
2013/0165252 A1 * 6/2013 Rice ..... A63B 53/04 473/329
2013/0165254 A1 * 6/2013 Rice ..... A63B 53/0466 473/329
2013/0324290 A1 * 12/2013 Oldknow ..... A63B 53/0466 473/324
2013/0337932 A1 * 12/2013 Kammerer ..... A63B 53/0487 473/251
2014/0080627 A1 * 3/2014 Bennett ..... A63B 59/0092 473/332
2014/0187346 A1 * 7/2014 Beno ..... A63B 53/06 473/332
2014/0349777 A1 * 11/2014 Beno ..... A63B 53/0475 473/223
2015/0094164 A1 * 4/2015 Galvan ..... A63B 60/54 473/329
2015/0119163 A1 * 4/2015 de la Cruz ..... A63B 60/54 473/329
2015/0174461 A1 * 6/2015 Bennett ..... A63B 53/0466 473/329
2015/0217167 A1 * 8/2015 Frame ..... A63B 60/54 473/329

* cited by examiner

GOLF CLUB HEAD AND DETACHABLE WEIGHTED SOLE PLATE AND COVER PLATE

TECHNICAL FIELD

The present invention relates to a golf club head and a method of providing a golf club head.

BACKGROUND ART

In recent years, various improvements have been made to golf clubs. For example, JP 2012-500044A proposes a golf club head that can be disassembled into multiple parts to allow the replacement of some of the parts. More specifically, this golf club head is constituted by a main body member and a sub body member, and the sub body member can be detached from the main body member. The sub body member is shaped so as to extend from the heel side of the head to the crown side, and the head design or the like can be changed according to the user's preference by replacing the sub body member.

SUMMARY OF INVENTION

The object of the above-described golf club head is to change the characteristics of the head by replacing a portion of the head, but if the change is too large, there is the risk of changing the swing characteristics and giving the user a sense of discomfort.

The present invention was achieved in order to resolve the above-described issues, and an object thereof is to provide a golf club head that has a changeable design while also suppressing a large change in swing characteristics, as well as a method of providing this golf club head.

A golf club head according to the present invention includes: a head body having a crown portion, a face portion, and a sole portion; at least one weight configured to be detachably attached to the sole portion; and a cover kit configured to be detachably attached to the sole portion, wherein out of a cover provided with a decoration and configured to cover at least a portion of the sole portion, and at least one auxiliary weight configured to be attached to the cover, the cover kit includes at least the cover, a weight of the cover kit is the same as a weight of the weight, and the sole portion is configured to selectively be in one of a first mode in which the weight is attached, and a second mode in which the cover kit is attached.

According to this configuration, after the weight attached to the head body is detached, a cover kit can be attached in its place. Since a decoration is provided on the surface of the cover of the cover kit, the head design can be easily changed by attaching the cover. Also, the weight of the cover kit is the same as the total weight of the detached weights, thus making it possible to suppress a change in the swing feeling.

In the above golf club head, the sole portion may include at least one recessed portion to which the weight is attached, and the cover may include a protrusion portion configured to be detachably engaged with the recessed portion. According to this configuration, when the cover is attached to the sole portion, positioning with respect to the sole portion can be performed easily.

In the above golf club head, the cover kit may include the cover and the at least one auxiliary weight.

In the above golf club head, the auxiliary weight may be detachably attached to the cover. According to this configuration, the weight of the cover kit can be changed when the cover kit is attached, thus making it possible to change the position of the center of gravity of the head according to the user's preference.

A method of providing a golf club head according to the present invention includes: a step of providing a golf club head including a crown portion, a face portion, a sole portion, and at least one weight configured to be detachably attached to the sole portion; and a step of providing at least one cover kit among a plurality of types of cover kits configured to be detachably attached to the sole portion, the cover kit including, out of a cover provided with a decoration and configured to cover at least a portion of the sole portion, and at least one auxiliary weight configured to be attached to the cover, at least the cover, wherein a weight of the cover kit is the same as a weight of the weight.

According to the present invention, it is possible to change the design while also being able to suppress a large change in the swing characteristics.

DESCRIPTION OF EMBODIMENTS

Figure 1:
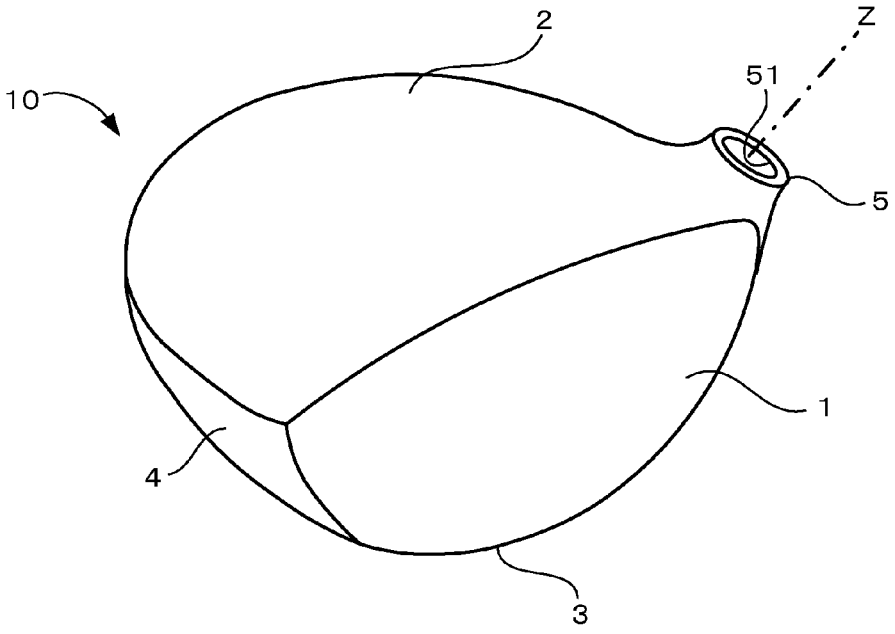
FIG. 1 is a perspective view of a reference state of one golf club head in a golf club set according to an embodiment of the present invention.
Figure 2:
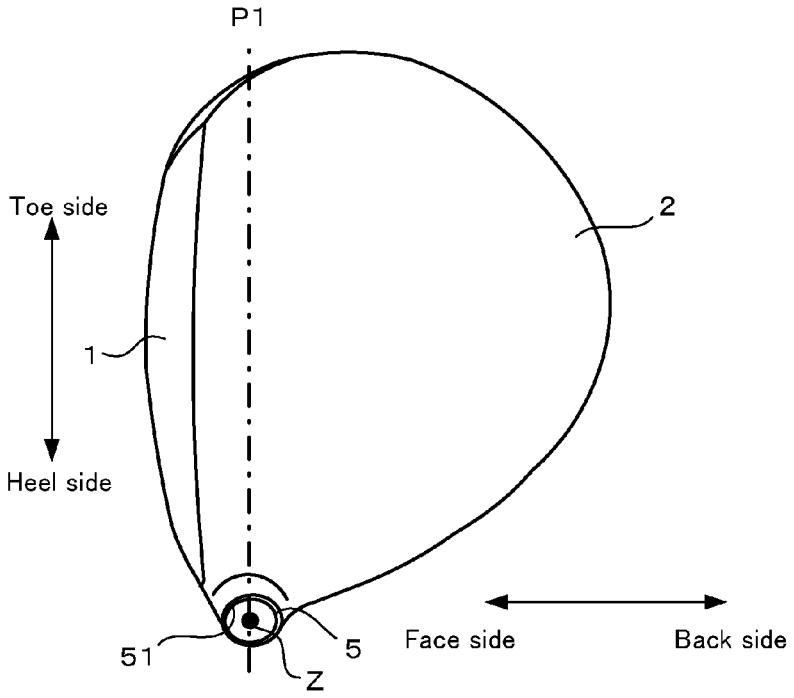
FIG. 2 is a plan view of FIG. 1.

An embodiment of a golf club head according to the present invention will be described below with reference to the drawings. FIG. 1 is a perspective view of a reference state of the golf club head of the present embodiment, and FIG. 2 is a plan view of FIG. 1. Note that the reference state of the golf club head will be described later.

1. Overview of Golf Club Head

The golf club head (hereinafter sometimes simply referred to as the "head") of the present embodiment is a wood-type golf club head, and includes a head body 10, weights 7 attached thereto, and a cover kit 8 that covers a portion of the head body. These members will be described in detail below.

1-1. Overview of Head Body

As show in FIG. 1, the head body 10 of the present embodiment is a hollow structure and has wall surfaces formed by a face portion 1, a crown portion 2, a sole portion 3, a side portion 4, and a hosel portion 5. The face portion 1 has a face surface, which is the surface for hitting a ball, and the crown portion 2 is adjacent to the face portion 1 and constitutes the upper surface of the head body 10. The sole portion 3 constitutes the bottom surface of the head, and is adjacent to the face portion 1 and the side portion 4. Also, the side portion 4 is the portion between the crown portion 2 and the sole portion 3, and extends from the toe side of the face portion 1, across the back side of the head body 10, to the heel side of the face portion 1. Furthermore, the hosel portion 5 is the portion provided adjacent to the heel side of the crown portion 2, and has an insertion hole 51 for the insertion of the shaft (not shown) of the golf club. A central axis Z of the insertion hole 51 conforms to the axis of the shaft. Note that the sole portion 3 is configured such that the aforementioned weights 7 can be attached thereto, and this aspect will be described later.

The following describes the aforementioned reference state. First, as shown in FIGS. 1 and 2, the reference state is defined as a state in which the central axis Z is in a plane P1 that is perpendicular to the ground (horizontal plane), and furthermore the head is placed on the ground at a predetermined lie angle and real loft angle. The plane P1 will be referred to as the reference vertical plane. Also, as shown in FIG. 2, the direction of the line of intersection of the reference vertical plane P1 and the ground will be referred to as the toe-heel direction, and the direction that is perpendicular to the toe-heel direction and parallel to the ground will be referred to as the face-back direction.

In the present embodiment, the boundary between the sole portion 3 and the face portion 1, and the boundary between the sole portion 3 and the side portion 4 can be defined as follows. Specifically, if ridge lines are formed between the sole portion 3 and the face portion 1, and between the sole portion 3 and the side portion 4, those ridge lines serve as the boundaries. Also, although the head body 10 of the present embodiment has the side portion 4, in the case where the side portion 4 is not provided, and the sole portion 3 and the crown portion 2 are directly connected for example, the ridge line between the sole portion 3 and the crown portion 2 serves as the boundary between the two. Also, if a clear ridge line is not formed, the boundary is the outline that is seen when the head body is placed in the reference state and viewed from directly above the center of gravity of the head body.

Note that although an upper limit is not particularly defined for the volume of the head body 10, practically it is, for example, desirably 500 $cm^3$ or less, or desirably 470 $cm^3$ or less when complying with R&A or USGA rules and regulations.

Also, the head body 10 can be formed from a titanium alloy having a specific gravity of approximately 4.4 to 5.0 (Ti-6Al-4V), for example. Besides a titanium alloy, the head can be formed from one or two or more materials selected from among stainless steel, maraging steel, an aluminum alloy, a magnesium alloy, an amorphous alloy, and the like.

Note that the head body 10 of the present embodiment is constituted by combining a head structure body that has at least the sole portion 3 with another portion. For example, a configuration is possible in which only the face portion 1 is constituted by another member, and the head is constituted by attaching the face portion 1 to the head structure body, and it is also possible to constitute a head body 10 by forming a head structure body in which an opening is provided in the crown portion 2 and the side portion 4, and blocking the opening with another member.

1-2. Overview of Sole Portion, Weights

As described above, the weights 7 are detachably attached to the sole portion 3. Although weights 7 can be attached at two places on the sole portion 3 in the present embodiment, there are no particular limitations on the number of weights 7. Note that the attachment structure for the weights 7 satisfies the Rules of Golf stipulated by the R&A (Royal and Ancient Golf Club of Saint Andrews). Specifically, this weight attachment structure satisfies the requirements stipulated in "1.b Adjustability" under "1. Clubs" in "Appendix II—DESIGN OF CLUBS" stipulated by the R&A. The following requirements (i), (ii), and (iii) are defined under "1.b Adjustability".

(i) The adjustment cannot be readily made;

(ii) all adjustable parts are firmly fixed and there is no reasonable likelihood of them working loose during a round; and (iii) all configurations of adjustment conform with the Rules.

Figure 3:
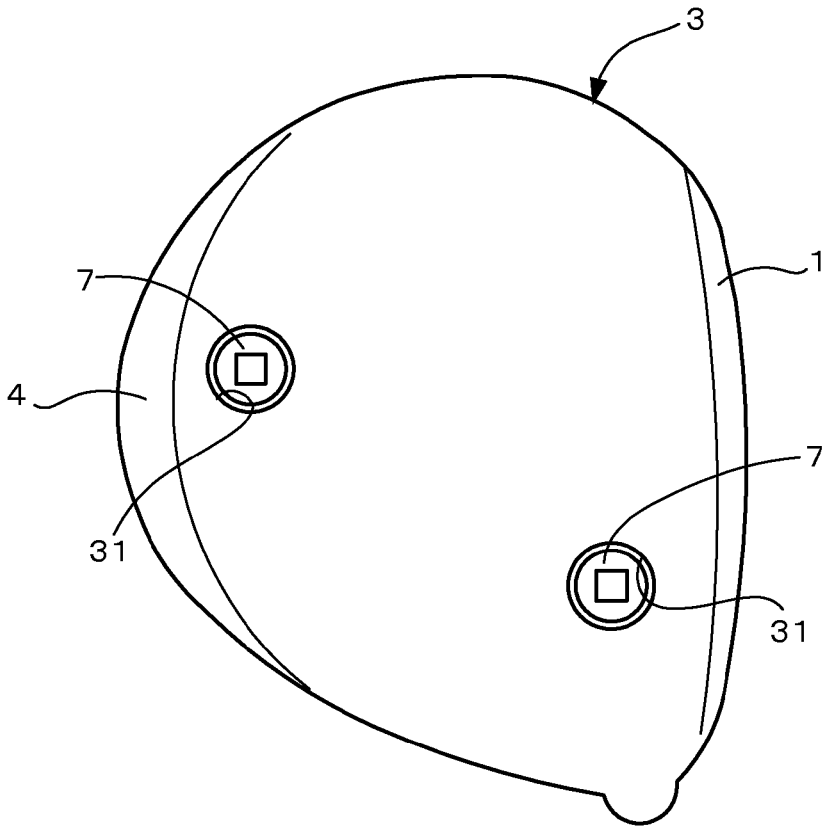
FIG. 3 is a bottom view of the golf club head of FIGS. 1 and 2 as viewed from below.
Figure 4:
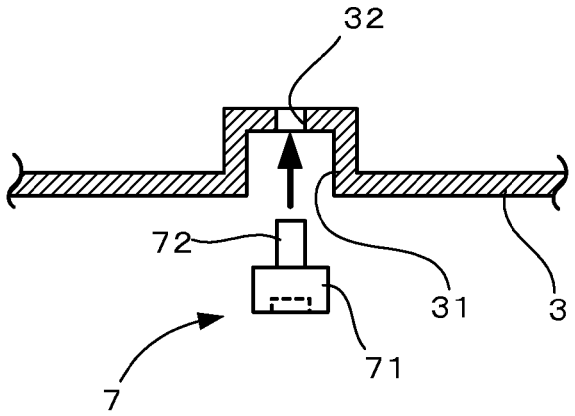
FIG. 4 is a partial enlarged cross-sectional view of a sole portion.

The sole portion 3 of the head body 10 is configured as follows. FIG. 3 is a view of the head body from the sole portion side, and FIG. 4 is an enlarged cross-sectional view of the sole portion of the head body. As shown in FIGS. 3 and 4, two recessed portions 31 are formed in the surface of the sole portion 3, and a threaded hole 32 is formed in the bottom surface of each of the recessed portions 31. The weights 7 are attached to these recessed portions 31. Each weight 7 includes a weight body 71 that is circular in a plan view, and a male thread portion 72 formed on the bottom surface of the weight body 71. Accordingly, the weight 7 is fixed to the recessed portion 31 by screwing the male thread portion 72 into the threaded hole 32 of the recessed portion 31.

2. Cover Kit

Figure 5:
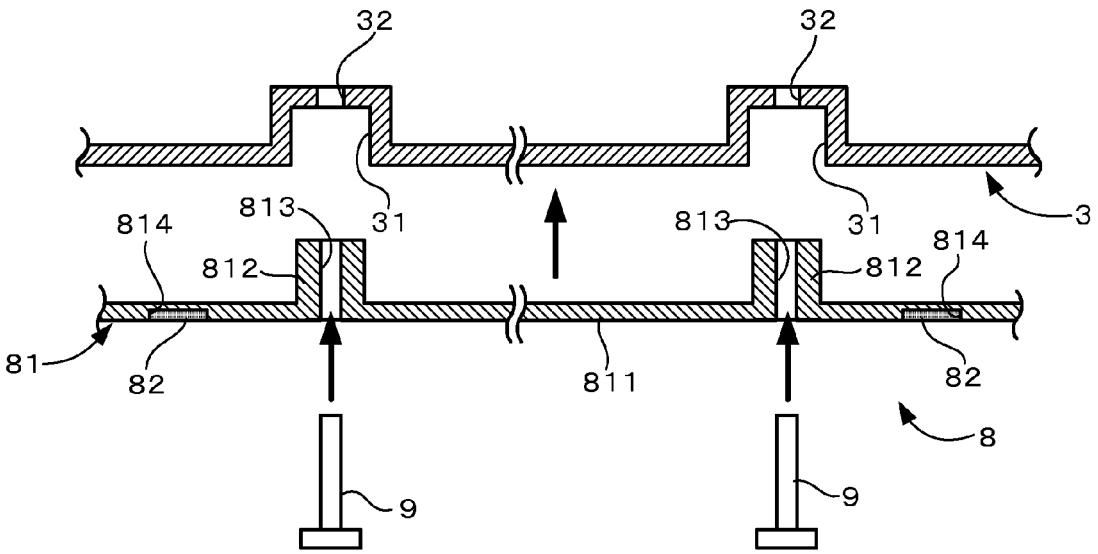
FIG. 5 is a cross-sectional view of the sole portion and a cover kit.
Figure 6:
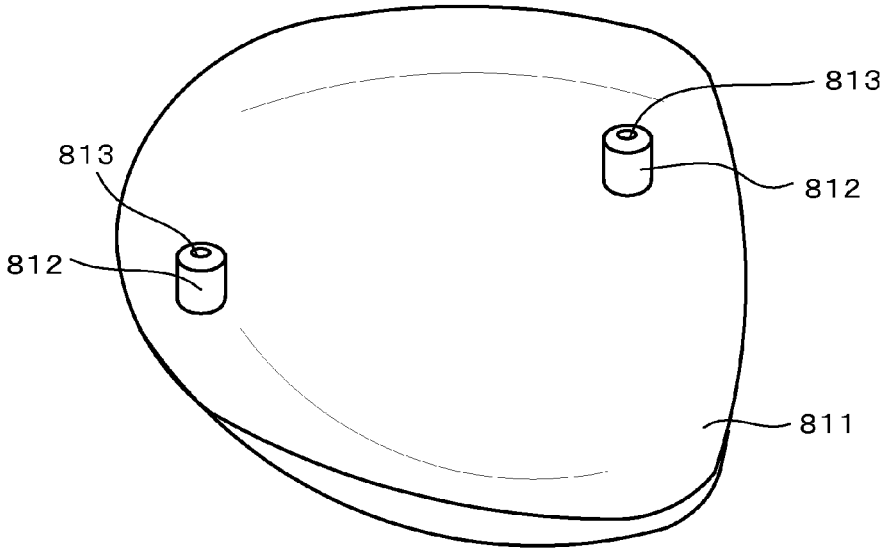
FIG. 6 is a perspective view of a cover.

Next, the cover kit 8 will be described. FIG. 5 is a cross-sectional view of the cover kit, and FIG. 6 is a perspective view of FIG. 5. The cover kit 8 includes a cover 81 that covers the sole portion 3, and at least one auxiliary weight 82 attached to the cover 81. The cover 81 includes a plate-shaped cover body 811 and two protruding portions 812 that protrude from the cover body 811. The cover body 811 has approximately the same shape as the sole portion 3, and is curved so as to extend along the surface of the sole portion 3. Also, a decoration is provided on the upper surface of the cover body 811, whereas the two aforementioned protruding portions 812 are formed on the lower surface. The positions of the two protruding portions 812 correspond to the positions of the recessed portions 31 of the sole portion 3, and the protruding portions 812 fit into the recessed portions 31 when the cover body 811 is attached to the sole portion 3. Also, a through-hole 813 extending to the upper surface of the cover body 811 is formed in each of the protruding portions 812, a screw 9 is inserted into the through-hole 813, and the screw 9 is screwed into the threaded hole 32 of the recessed portion 31.

Also, multiple recessed portions 814 are formed in the upper surface of the cover body 811, and auxiliary weights 82 are fixed in the recessed portions 814.

The cover body 811 can be formed from various materials such as a metal or resin material. Also, the auxiliary weights 82 are mainly formed from a metal.

The weight of the cover kit 8 configured as described above is adjusted so as to be the same as the total weight of the weights 7 attached to the sole portion 3. Note that there is no need to be exactly the same, and there may be a difference of −3 to 3 g, for example.

3. Method of Using Cover Kit

Next, a method of using the head body 10 and the cover kit 8 configured as described above will be described. As an initial state (first mode), the above-described weights 7 have been attached to the head body 10, and the center of gravity of the head body 10 has been adjusted using these weights 7. Accordingly, the position of the center of gravity of the head body 10 can be changed by replacing the weights 7 with weights having different weights.

Also, the above-described cover kit 8 can be attached in place of these weights 7. First, the weights 7 are rotated using a tool so as to remove the male thread portions 72 of the weights 7 from the threaded holes 32 in the recessed portions 31 of the sole portion 3. Next, the two protruding portions 812 on the cover 81 of the cover kit 8 are fitted into the recessed portions 31 of the sole portion 3. Accordingly, the cover 81 is positioned on the sole portion 3 and is arranged so as to cover the sole portion 3. Next, the screws 9 are inserted into the through-holes 813 from the upper surface side of the cover body 811, and the screws 9 are screwed into the threaded holes 32 in the recessed portions 31 of the sole portion 3. Accordingly, the cover 81 is fixed to the sole portion 3 (second mode).

4. Features

As described above, according to the configuration of the present embodiment, after the weights 7 attached to the head body 10 are detached, the cover kit 8 can be attached in their place. Also, since a decoration is provided on the surface of the cover 81 of the cover kit 8, the head design can be easily changed by attaching the cover 81.

Also, the weight of the cover kit 8 is the same as the weight of the detached weights 7, thus making it possible to suppress a change in the swing feeling.

In particular, if cover kits 8 having different designs and different positions for the auxiliary weights 81 are provided, the head design and center of gravity position can be changed according to the user's preference. Accordingly, it is possible to not only, for example, sell one or more types of cover kits 8 as a set with the head body 10 and the weights 7, but also sell the cover kits 8 separately to allow purchasing in accordance with the user's preference.

Also, the golf club head of the present embodiment can be used without using the cover kit 8. Specifically, if there is no need for a design change or the like, the golf club head in the initial state can be used as is, and the weights 7 need only be changed if there is a desire to change the center of gravity.

5. Variations

Although an embodiment of the present invention has been described above, the present invention is not limited to this embodiment, and various modifications can be made without departing from the gist of the invention. The following are examples of modifications that can be made.

5.1

There are no particular limitations on the shape of the cover body 811, and it need only have a shape that can cover the sole portion 3. Accordingly, it may have a shape that covers a portion of the sole portion 3, and may have a shape that extends to the boundaries that the sole portion 3 has with the face portion 1, side portion 4, and crown portion 2 as described above. Also, the various designs can be applied to the cover body 811, and the design can be configured by providing various images, graphics, and colors, as well as providing recessions and protrusions on the surface of the cover body 811.

5.2

Although the auxiliary weights 82 are fixed to the cover 81 in the above embodiment, the auxiliary weights 82 can be given a detachable configuration. This enables replacing the auxiliary weights 82, thus making it possible to adjust the center of gravity of the head.

5.3

Figure 7:
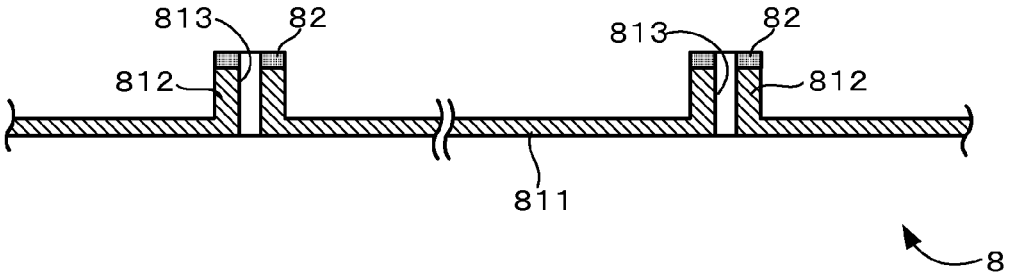
FIG. 7 is a cross-sectional view showing another example of the cover.

There are no particular limitations on the positions of the auxiliary weights 82, and the auxiliary weights 82 can be attached to any positions on the surface of the cover 81, such as being attached to the protruding portions 812 as shown in FIG. 7. In this case, it is preferable that the auxiliary weights 82 are formed as cylinders so as to not block the through-holes 813. In this way, by providing the auxiliary weights 82 on the protruding portions 812, the weight can be distributed at the same positions as the positions of the weights 7 that had originally been attached to the head body 10, thus making it possible to prevent a large change in the position of the center of gravity when the cover kit 8 is attached to the head body 10. Accordingly, it is possible to further suppress a change in the swing feeling.

5.4

There are no particular limitations on the number and shape of the auxiliary weights 82, and there are no particular limitations on the method of attaching the auxiliary weights 82 either. Also, a configuration is possible in which the auxiliary weights 82 are not provided. In this case, the cover kit 8 is constituted by only the cover 81, and the weight of the cover 81 is the same as the total weight of the weights 7.

5.5

There are no particular limitations on the method of attaching the cover body 811. Although it is attached to the sole portion using the screws 9 in the above embodiment, various methods such as fitting can be applied as long as detachable fixing can be achieved. Although the protruding portions 812 are provided on the cover body 811, the protruding portions 812 do not need to be provided. For example, a cover body 811 not provided with the protruding portions 812 can be screwed to the threaded holes 32 of the sole portion 3 using the screws 9.

5.6

There are no particular limitations on the method of fixing the weights 7 to the sole portion 3, and a method different from the above-described screwing may be applied as long as detachable attachment to the sole portion 3 can be achieved. Also, there are no particular limitations on the number of weights 7.

5.7

Although a wood-type golf club head is described in the above embodiment, the golf club head of the present invention can be applied to a so-called utility-type or hybrid-type golf club head as well.

REFERENCE SIGNS LIST

1 Face portion
2 Crown portion
3 Sole portion
7 Weight
8 Cover kit
10 Head body
31 Recessed portion
81 Cover
82 Auxiliary weight
814 Recessed portion

The invention claimed is:

1. A golf club head comprising:

a head body having a crown portion, a face portion, and a sole portion;

at least one regular weight member configured to be detachably attached to the sole portion; and a cover kit configured to be detachably attached to the sole portion, wherein the cover kit includes a cover provided with a decoration and configured to cover at least a portion of the sole portion, and optionally includes at least one auxiliary weight member configured to be attached to the cover, a weight of the cover kit is the same as a weight of the regular weight member, and the sole portion is configured to selectively be in one of a first mode in which the regular weight member is attached, and a second mode in which the cover kit is attached, wherein the sole portion includes at least one recessed portion to which the regular weight member is attached, and the cover includes a protrusion portion configured to be detachably engaged with the recessed portion.

2. The golf club head according to claim 1, wherein the cover kit includes both the cover and the at least one auxiliary weight member.

3. The golf club head according to claim 2, wherein the auxiliary weight member is detachably attached to the cover.

4. A method of providing a golf club head, comprising:

a step of providing a golf club head including a crown portion, a face portion, a sole portion, and at least one regular weight member configured to be detachably attached to the sole portion; and a step of providing at least one cover kit among a plurality of types of cover kits configured to be detachably attached to the sole portion, the cover kit including a cover provided with a decoration and configured to cover at least a portion of the sole portion, and optionally including at least one auxiliary weight member configured to be attached to the cover, wherein a weight of the cover kit is the same as a weight of the regular weight member, wherein the sole portion includes at least one recessed portion to which the regular weight member is attached, and the cover includes a protrusion portion configured to be detachably engaged with the recessed portion.

* * * * *